US010969191B2

(12) United States Patent
Wong et al.

(10) Patent No.: US 10,969,191 B2
(45) Date of Patent: Apr. 6, 2021

(54) CROSSBOW CAPABLE OF SWITCHING BETWEEN COMPOUND CROSSBOW AND RECURVE CROSSBOW

(71) Applicant: ZENG CHENG HUA CHANG PLASTIC & METAL MOULDING CO., LTD., Guangzhou (CN)

(72) Inventors: Chin Fu Wong, Guangzhou (CN); Wenzhe Pan, Guangzhou (CN); Xike Yang, Guangzhou (CN)

( * ) Notice: Subject to any disclaimer, the term of this patent is extended or adjusted under 35 U.S.C. 154(b) by 0 days.

(21) Appl. No.: 16/690,149

(22) Filed: Nov. 21, 2019

(65) Prior Publication Data

US 2021/0033368 A1 Feb. 4, 2021

(30) Foreign Application Priority Data

Jul. 29, 2019 (CN) ..... 201910689234.4

(51) Int. Cl.
*F41B 5/12* (2006.01)

(52) U.S. Cl.
CPC ..... *F41B 5/123* (2013.01)

(58) Field of Classification Search
CPC ..... F41B 5/12; F41B 5/123
See application file for complete search history.

(56) References Cited

U.S. PATENT DOCUMENTS

| | | | | |
|---|---|---|---|---|
| 5,522,373 | A * | 6/1996 | Barnett | F41B 5/12 124/23.1 |
| 7,178,514 | B2 * | 2/2007 | Chang | F41B 5/123 124/25 |
| 8,033,275 | B2 * | 10/2011 | Bednar | F41B 5/123 124/25 |
| 9,121,659 | B1 * | 9/2015 | Chang | F41B 5/14 |
| 10,139,190 | B1 * | 11/2018 | Trpkovski | F41A 11/00 |
| 2014/0283805 | A1 * | 9/2014 | Dunlop | F41B 5/1403 124/25 |
| 2020/0011632 | A1 * | 1/2020 | Chang | F41B 5/105 |
| 2020/0191518 | A1 * | 6/2020 | Egerdee | F41B 5/1403 |

* cited by examiner

*Primary Examiner* — John A Ricci
(74) *Attorney, Agent, or Firm* — Prakash Nama; Global IP Services, PLLC

(57) ABSTRACT

A crossbow is capable of switching between a compound crossbow and a recurve crossbow, comprising a fore unit and a stock. The stock comprises a stock body, and the stock body is provided with a front end. The fore unit is provided with a mounting end; the mounting end of the fore unit is mounted on the front end of the stock body through a connecting bolt, and the mounting end and the front end are of detachable mounting structures. The fore unit is a compound riser unit or a recurve-bow unit, which is assembled with the stock to constitute a compound crossbow or a recurve crossbow. In the invention, the stock can be quickly assembled with and detached from the compound riser unit and the recurve-bow unit to switch the crossbow between the compound crossbow and the recurve crossbow. The users' expenses are reduced, and the operation is more convenient.

6 Claims, 5 Drawing Sheets

CROSSBOW CAPABLE OF SWITCHING BETWEEN COMPOUND CROSSBOW AND RECURVE CROSSBOW

BACKGROUND OF THE INVENTION

This invention relates to crossbows used by sportsmen and hunters, and more specifically to a crossbow capable of switching between a compound crossbow and a recurve crossbow.

Bows and crossbows had gradually faded out in modern times due to rapid development of firearms. However, crossbows which do not generate sound, light and heat during shooting, can not only shoot targets from concealed places, but also avoid igniting combustibles and explosives nearby. Crossbows play an important role in modern anti-terrorism and special battles again due to above advantages. Therefore, after being neglecting hundreds of years, crossbows again draw high attention from some national military forces and hunting enthusiasts.

Compound crossbows are modern products, with a complicated structure and many parts and components. Compound crossbows have a relatively long effective flightshot, are small in sizes and convenient to carry during hunting in forests. However, compound crossbows are high in manufacturing cost due to many parts and components, and must be installed and maintained with special tools. Generally, compound crossbows cannot be installed and maintained by users themselves, have a relatively short life span, and are complicated in maintenance. Recurve crossbows have a simple structure and are easily maintained, which have been used for thousand years. The recurve crossbows have relatively less components, and are consistent and stable in performance and high in shooting accuracy. Under the condition of the same functions, the price of recurve crossbows is usually 30-50% of that of the compound crossbows. However, recurve crossbows have a relatively short effective flightshot and a relatively larger size, full draw weight reducing the trigger mechanism's life, and are inconvenient to carry during hunting in forests. Thus it can be seen that the compound crossbows and the recurve crossbows respectively have own advantages and disadvantages.

Generally, compound crossbows and recurve crossbows in the market have respective unique features and share less exchangeable components. It is difficult to assemble the compound crossbow and the recurve crossbow together for switching, which greatly increases the production cost. If a user needs to purchase an entire compound crossbow and an entire recurve crossbow at the same time, it increases his expenses.

BRIEF SUMMARY OF THE INVENTION

In order to solve the above technical problems, the invention provides a crossbow capable of switching between a compound crossbow and a recurve crossbow. The invention presents the following technical solution.

A crossbow capable of switching between a compound crossbow and a recurve crossbow includes a fore unit and a stock, wherein the stock includes a stock body, the stock body is provided with a front end; the fore unit is provided with a mounting end, the mounting end of the fore unit is mounted on the front end of the stock body through a connecting bolt, and the mounting end and the front end are of detachable mounting structures.

Wherein the fore unit is a compound riser unit, the compound riser unit and the stock are assembled to constitute a compound crossbow. Alternatively the fore unit is a recurve-bow unit, and the recurve-bow unit and the stock are assembled to constitute a recurve crossbow.

The mounting end of the fore unit is mounted at the front end of the stock body through a connecting bolt.

The front end of the stock body includes a cable slide horizontally formed at front portion of the stock body, the cable slide divides front portion of the stock body into an upper segment and a lower segment, the mounting end of the fore unit includes a fixed block and an arrow-track block arranged on the fixed block, the arrow-track block is inserted in the cable slide and is in a locked connection with the upper segment, and the fixed block is in a screwed connection with the lower segment through a connecting bolt.

Two recess grooves are formed on each side of the upper segment of the stock body, and the arrow-track block on the fixed block is held onto the recess grooves.

The lower segment of the stock body is formed with a threaded hole, and the connecting bolt is screwed and tightened into it.

The compound riser unit includes a riser, limbs, two cams, a string, two cables and etc. The fixed block and the arrow-track block are integrated into the riser and mounted at the front end. The limbs are respectively installed on each side of the riser. The string and two cables are installed on the cams. The connecting bolt penetrates through the fixed block and then is screwed in the lower segment of the stock body.

The recurve-bow unit includes a recurve bow, a string, a front connecting block, a rear connecting block, a connecting plate, a foot stirrup and etc. The rear connecting block is arranged as a fixed block, the rear connecting block is mounted and connected with the lower segment of the stock body through a connecting bolt. The front connecting block and the rear connecting block are locked and connected with each other through bolts. The central position of the recurve bow is tightly clamped between the front connecting block and the rear connecting block. The front connecting block and rear connecting block respectively have an arrow-track. The foot stirrup is mounted and connected with the front connecting block and the rear connecting block in their lower half portions.

One bolt extends through the foot stirrup, the front connecting block and screwed in the side block. The other bolt extends through the foot stirrup, the rear connecting block and screwed in the side block.

By configuring the corresponding stock and fore unit, the invention can realize quick switching between the compound crossbow and the recurve crossbow, greatly reducing the users' expenses. Meanwhile, the same stock can be used for both recurve-bow unit and compound riser unit, so that the cost and time for research and development on new stock can be lowered.

BRIEF DESCRIPTION OF THE DRAWINGS

Other features in this invention will become clear from the attached drawings, which illustrated one preferred embodiment of the crossbow of this invention, wherein.

DETAILED DESCRIPTION OF THE INVENTION

To further clarify the features and technical means of the invention and the specific purposes to be fulfilled as well as the functions to be obtained, the invention is further described in detail in conjunction with attached drawings and preferred embodiments.

Figure 1:
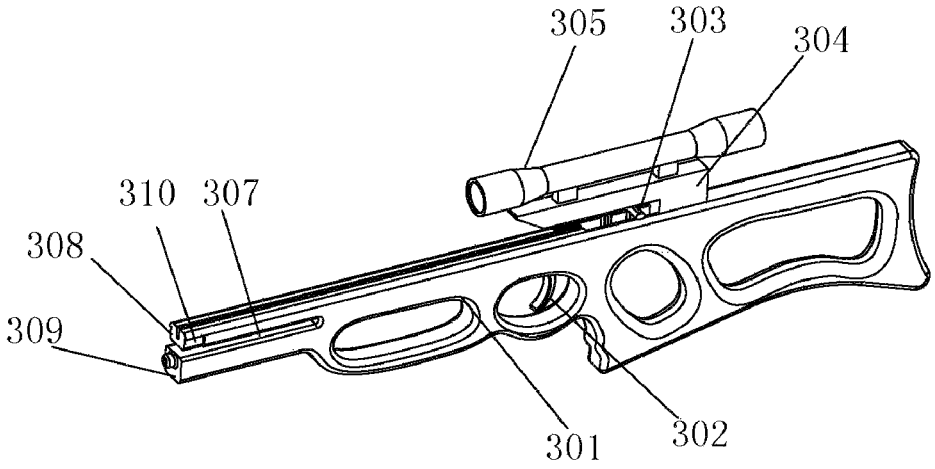
FIG. 1 is a top perspective view of one preferred embodiment of the crossbow of this invention with a stock.
Figure 2:
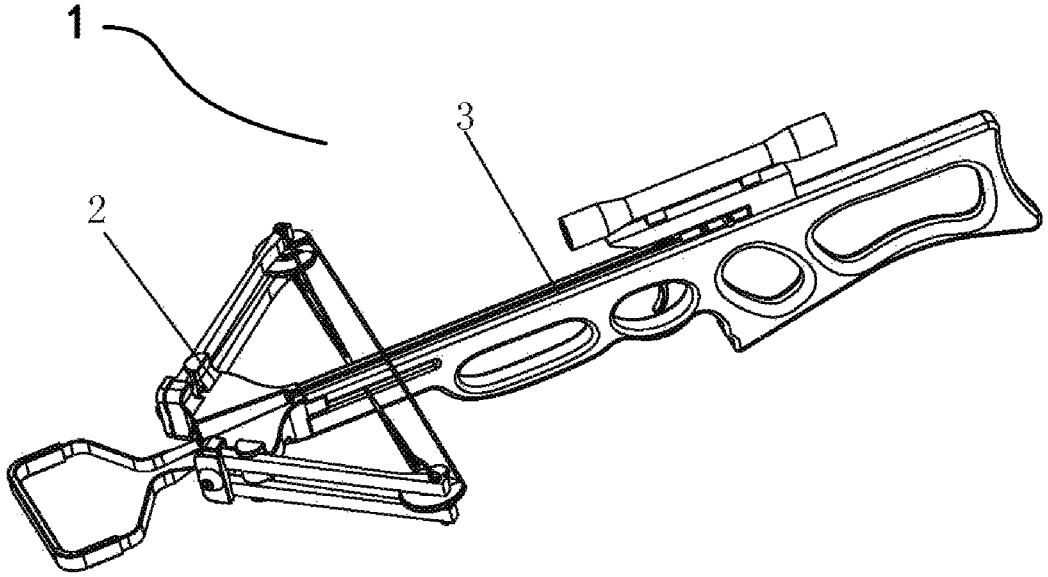
FIG. 2 is a top perspective view of one preferred embodiment of the crossbow of this invention with a compound crossbow comprises a stock and a compound riser unit.
Figure 3:
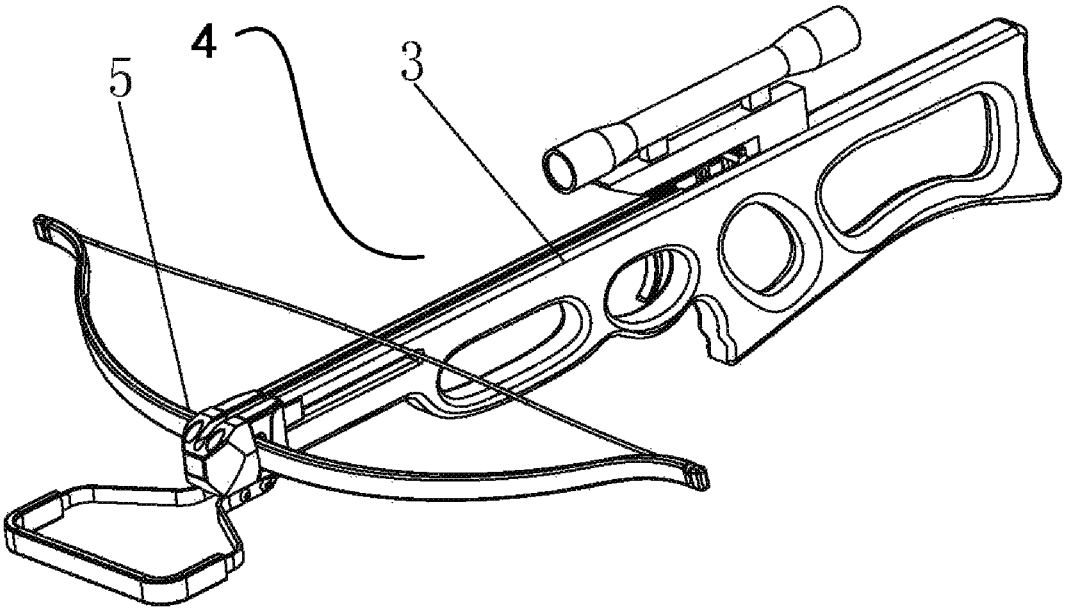
FIG. 3 is a top perspective view of one preferred embodiment of the crossbow of this invention with a recurve crossbow comprises a stock and a recurve-bow unit.
Figure 4:
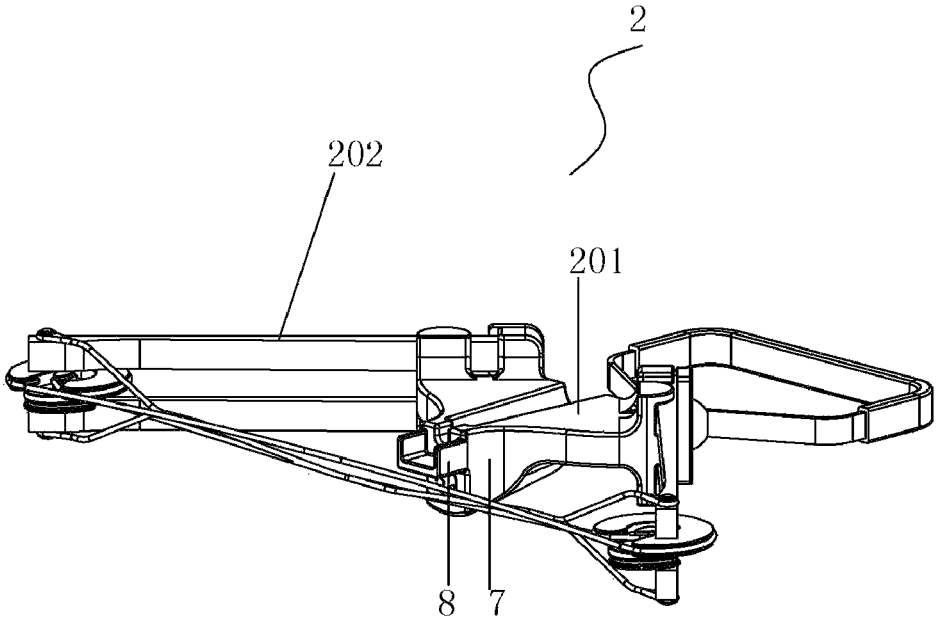
FIG. 4 is a top perspective view of one preferred embodiment of the crossbow of this invention with a compound riser.
Figure 5:
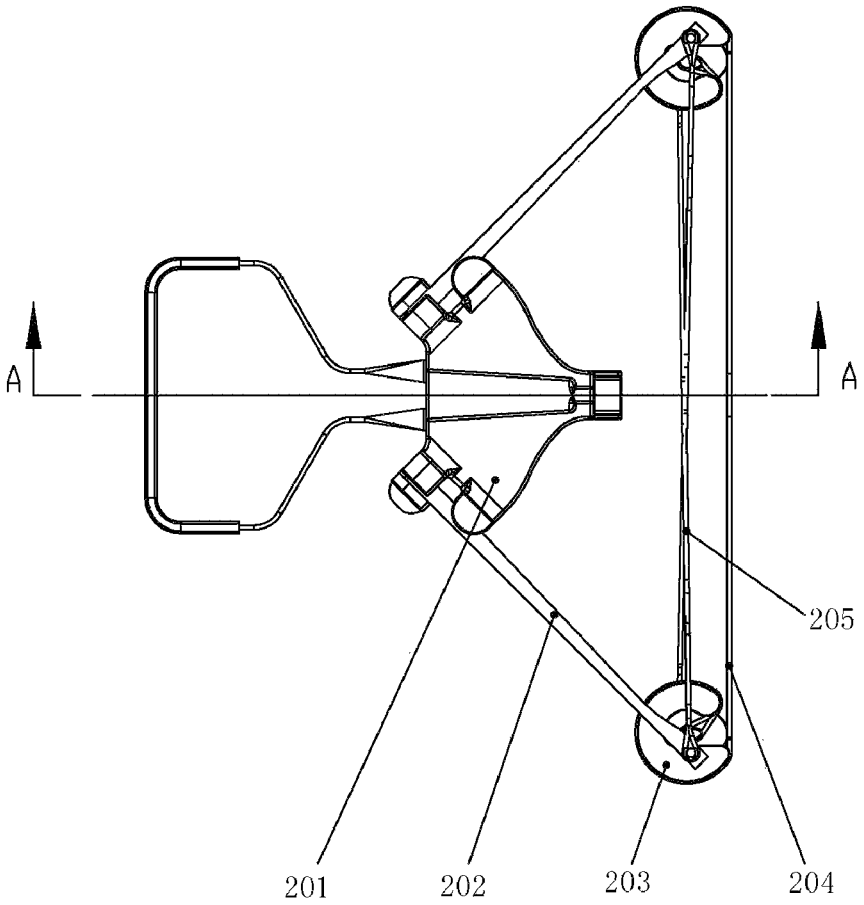
FIG. 5 is a top view of FIG. 4.
Figure 6:
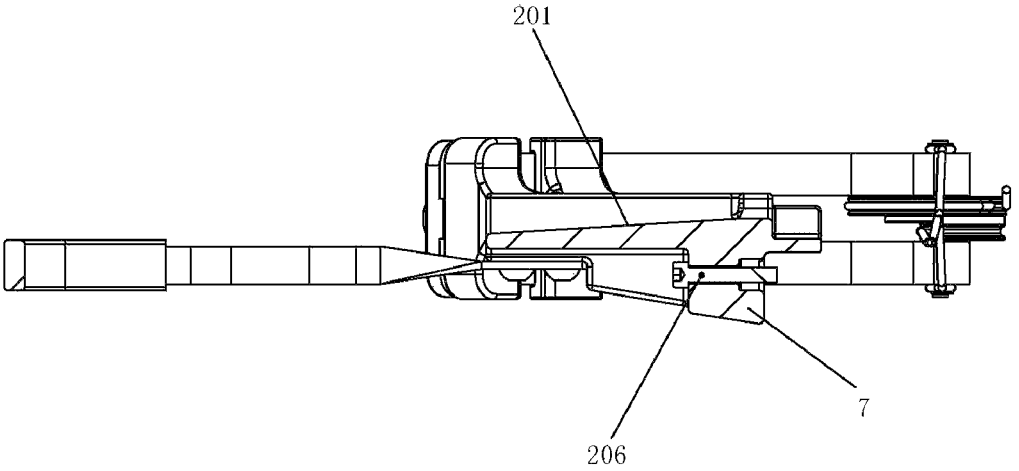
FIG. 6 is a cross-sectional view of FIG. 5 along line A-A.
Figure 7:
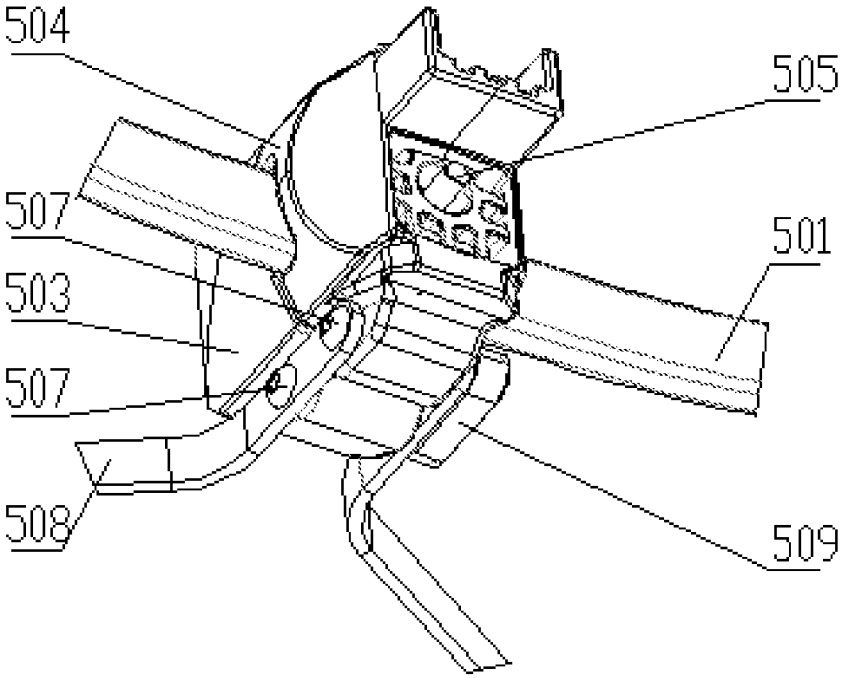
FIG. 7 is a bottom perspective view of one preferred embodiment of the crossbow of this invention with a recurve-bow unit.
Figure 8:
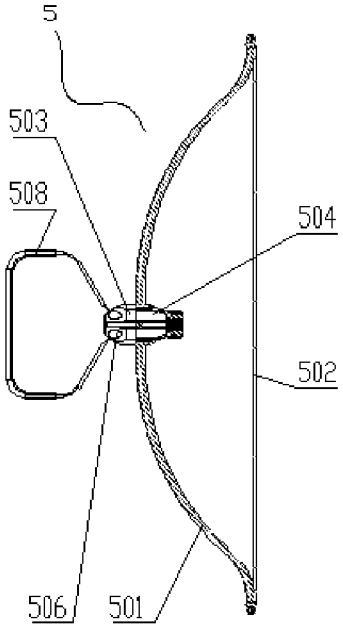
FIG. 8 is a top view of one preferred embodiment of the crossbow of this invention with a recurve-bow unit.
Figure 9:
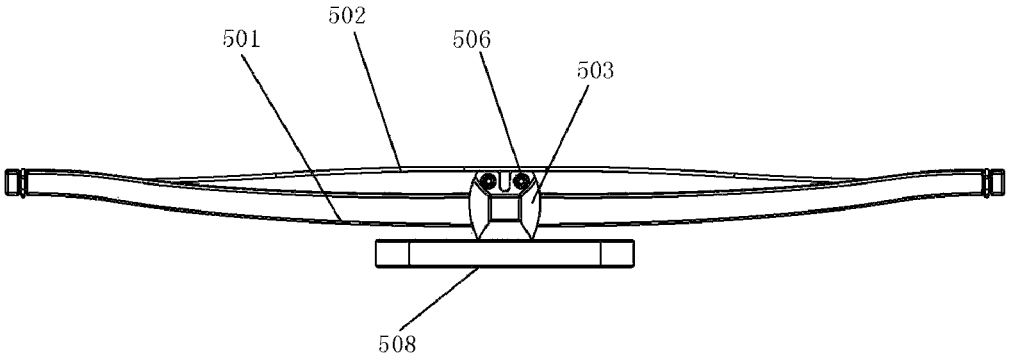
FIG. 9 is a side view of FIG. 8.

FIGS. 1-9 illustrate one preferred embodiment of the crossbow of this invention, a crossbow capable of switching between a compound crossbow and a recurve crossbow, including a fore unit and a stock 3. The stock 3 includes a stock body 301, and the stock body 301 is provided with a front end. The fore unit is provided with a mounting end, the mounting end of the fore unit is mounted on the front end of the stock 3 through a connecting bolt, and the mounting end and the front end are of detachable mounting structures. The fore unit is capable of switching between a compound riser unit 2 and a recurve-bow unit 5, when the fore unit is the compound riser unit 2, the fore unit is assembled with the stock 3 to constitute a compound crossbow 1, and when the fore unit is the recurve-bow unit 5, the fore unit is assembled with the stock 3 to constitute a recurve crossbow 4. Through the detachable mounting structures, the fore unit can be conveniently mounted and detached, so that the crossbow can be switched between the compound crossbow 1 and the recurve crossbow 4 with only one stock 3, be more convenient to carry.

With this invention, the compound crossbow stock 3 will be able to fit both the compound riser unit 2 and recurve-bow unit 5.

Besides, the stock body 301 is provided with a trigger 302, a safety mechanism 303, a scope mount 304 and a scope 305. Crossbow arrows can be fired by turning on the safety mechanism 303 and then pulling the trigger 302, which is a well-known structure and is not described in detail in this invention.

The mounting end of the fore unit is locked at the front end of the stock body 301 through a connecting bolt, so that the mounting end can be conveniently mounted and dismounted. Certainly, the mounting end and the front end can also be installed in a clamping method through a clamp structure. For example, the mounting end is provided with a protuberance, while the front end is formed with a recess groove, and the protuberance is clamped in the recess groove so that the protuberance and the recess groove are fastened through clearance fit, or other existing clamp structures apply.

The front end of the stock body 301 includes a cable slide 307 formed at the front end of the stock body 301, and the cable slide 307 divides the front end of the stock body 301 into an upper segment 308 and a lower segment 309. The mounting end of the compound riser unit 2 includes a fixed block 7 and an arrow-track block 8. The arrow-track block 8 arranged on the fixed block 7. The arrow-track block 8 is inserted in the cable slide 307 and is firmly connected with the upper segment 308. And the fixed block 7 is connected with the lower segment 309 through a connecting bolt 206. With the cable slide 307, the arrow-track block 8 can be conveniently inserted, improving rigidity and accuracy of installation and obtaining an oriented installation function. The end face of the fixed block 7 fits the end face of the stock body 301.

Besides, there are two recess grooves 310 are formed on each side of the upper segment 307 of the stock body 301. A protruded part of the track 8 will fit into the grooves on 310. The assembly will be both secure and compact.

The lower segment 309 of the stock body 301 is formed with a threaded hole, and the connecting bolt 206 is screwed into the threaded hole. By using this threaded hole, the connecting bolt 206 is conveniently screwed in, improving assembly efficiency and crossbow accuracy.

As shown in FIGS. 1-9, the invented structure of the mounting end in the fore unit and the invented structure of the front end of the stock 3 both ensure that the fore unit can be quickly assembled and detached, capable of switching of different fore units.

The following is detailed description of crossbows equipped with different types of fore units.

As shown in FIG. 2 and FIGS. 4-6, the compound riser unit 2 includes a riser 201, limbs 202, cams 203, a string 204 and cables 205, and so on. The fixed block 7 and arrow-track block 8 are portions of the riser 201. The limbs 202 are installed on each side of the riser 201. The string 204 and cables 205 are installed on the limbs 202. The connecting bolt 206 penetrates through the fixed block 7 and then is locked in the lower segment 309 of the stock body 301, so that the fixed block 7 and the riser 201 is kept in steady installation and connection to fulfill the purpose of assembling the compound riser unit 2 and the stock 3 together. The arrow-track block 8 is arranged on the fixed block 7. The fixed block 7 serves as the mounting end of the compound riser unit 2. The connecting bolt 206 penetrates through the fixed block 7 and then is screwed in the threaded hole of the lower segment 309 of the stock body 301, thus the compound riser unit 2 is steadily assembled with the stock 3. So they together constitute a compound crossbow 1.

As shown in FIG. 3 and FIGS. 7-9, a recurve-bow unit 5 includes a recurve bow 501, a string 502, a front connecting block 503, a rear connecting block 504 and a foot stirrup 508, and etc. The lower portion of the rear connecting block 504 is arranged as a fixed block. The upper portion of the rear connecting block 504 is arranged as an arrow-track block. The rear connecting block 504 is mounted and connected with the stock body 301 through a connecting bolt 505. The front connecting block 503 and the rear connecting block 504 are locked and connected through a locking bolt 506. The central position of the recurve bow 501 is clamped between the front connecting block 503 and the rear connecting block 504. The front connecting block 503 and the rear connecting block 504 both have an arrow-track. The foot stirrup 508 is installed and connected with the front connecting block 503 and the rear connecting block 504. A transverse bolt 507 extends through foot stirrup 508 and the front connecting block 7, and is screwed in a connecting plate 509. Another transverse bolt 507 extends through foot stirrup 508 and the rear connecting block 8, and also is screwed in a connecting plate 509.

During specific installation, the string 502 is installed on the recurve bow 501. First, the rear connecting block 504 is mounted to the front end of stock body 301 with the connecting bolt 505; then, the recurve bow 501 is clamped between the front connecting block 503 and the rear connecting block 504; next, the front connecting block 503 and the rear connecting block 504 are fixed together using the locking bolts 506 while the recurve bow 501 is clamped. Thus, the front connecting block 503, the recurve bow 501 and the rear connecting block 504 are assembled. The foot stirrup 508 is mounted below the front connecting block 503 and the rear connecting block 504. Two transverse bolts 507 penetrate through the foot stirrup 508, the front connecting block 503 and the rear connecting block 504, and then are screwed into the connecting plate 509 to lock them together, meanwhile to capture the recurve bow 501, thereof to provide additional strengthening and support against the forces exerted on the stock 3 by recurve bow 501 when it is cocked and fired.

Besides, in order to ensure the normal use of the recurve crossbow 4, the recurve bow 501 and the string 502 can both be set in the aspect of size and specification to meet corresponding size requirements.

From the above it can be seen that, for the recurve-bow unit 5 and the compound riser unit 2, their detaching structures need to be correspondingly set to meet the requirements of being installed with and detached from the stock 3, further obtaining the basic structure in which the recurve-bow unit 5 and the compound riser unit 2 share one stock body 301.

By this solution, when using a crossbow, users only need to carry a stock 3, a compound riser unit 2 and a recurve-bow unit 5 instead of buying an entire compound crossbow 1 and an entire recurve crossbow 4. The stock 3, the compound riser unit 2 and the recurve-bow unit 5 also can be detachably carried, improving the portability.

The following is brief description of the operation of switching the crossbow between the compound crossbow 1 and the recurve crossbow 4 by users themselves. When the compound crossbow 1 is required, the compound riser unit 2 is locked on the stock body 301 with the connecting bolt 206. At this moment, the stock 3 and the compound riser unit 2 constitute a compound crossbow 1 which can be used. After using the compound crossbow 1, the compound riser unit 2 can be detached from the stock 3 by removing the connecting bolt 206; then, the recurve-bow unit 5 is installed on the stock 3 to constitute a recurve crossbow 4. Similarly, after using the recurve crossbow 4, a reverse procedure is employed, the recurve-bow unit 5 can be removed, and then the compound riser unit 2 can be installed on the stock 3 to constitute the compound crossbow 1, thus capable of quick switching between the compound crossbow 1 and the recurve crossbow 4.

While foregoing describes one preferred embodiment of the crossbow of this invention, it is be understood that this description is to be considered only as illustrative of the principles of the invention and is not to be limitative thereof, as numerous other variations, all within the scope of the invention will readily occur to others.

What is claimed is:

1. A crossbow capable of switching between a compound crossbow and a recurve crossbow, characterized by comprising a fore unit and a stock, wherein the stock comprises a stock body, the stock body is provided with a front end, the fore unit is provided with a mounting end, the mounting end of the fore unit is mounted on the front end of the stock body through a connecting bolt, and the mounting end and the front end are of detachable mounting structures, Wherein the fore unit is a compound riser unit, the compound riser unit and the stock are assembled to constitute a compound crossbow; alternatively, the fore unit is a recurve-bow unit, and the recurve-bow unit and the stock are assembled to constitute a recurve crossbow; the front end of the stock body comprises a cable slide horizontally formed at a front end of the stock body; the cable slide divides the front end of the stock body into an upper segment and a lower segment; the mounting end of the fore unit comprises a fixed block and an arrow-track block arranged on the fixed block; the arrow-track block is inserted in the cable slide and is in a fastened connection with the upper segment, and the fixed block is fixed with a connecting bolt.

2. The crossbow capable of switching between a compound crossbow and a recurve crossbow according to claim 1, characterized in that two recess grooves are formed on each side of the upper segment of the stock body, and the arrow-track block clamps in the recess grooves.

3. The crossbow capable of switching between a compound crossbow and a recurve crossbow according to claim 2, characterized in that the lower segment of the stock body is formed with a threaded hole, and the connecting bolt is screwed in the threaded hole.

4. The crossbow capable of switching between a compound crossbow and a recurve crossbow according to claim 3, characterized in that the fore unit is a compound riser unit; the compound riser unit comprises a riser, limbs, cams, a string and two cables; the fixed block and arrow-track block are portions of the riser; the limbs are respectively arranged on each side of the riser; the string and the cables are installed on the limbs; and the connecting bolt penetrates through the fixed block and then is screwed in the lower portion of the stock body.

5. The crossbow capable of switching between a compound crossbow and a recurve crossbow according to claim 3, characterized in that the fore unit is a recurve-bow unit; the recurve-bow unit comprises a recurve bow, a string, a front connecting block, a rear connecting block and a foot stirrup; the rear connecting block is arranged as the fixed block; the rear connecting block is mounted and connected with the stock body through a connecting bolt; the front connecting block and the rear connecting block are fixed with at least one, and preferably a plurality of locking bolts; the central position of the recurve bow is tightly clamped between the front connecting block and the rear connecting block; the front connecting block and the rear connecting block both are formed with an arrow-track; and the foot stirrup is mounted with the front connecting block and the fixed block.

6. The crossbow capable of switching between a compound crossbow and a recurve crossbow according to claim 5, characterized in that the front connecting block and the rear connecting block are respectively mounted with at least one, and preferably a plurality of transverse bolts, and the transverse bolts extend to penetrate through the foot stirrup and then are screwed in a connecting plate.

* * * * *